US005779124A

United States Patent [19]

Akira

[11] Patent Number: 5,779,124

[45] Date of Patent: Jul. 14, 1998

[54] NEGATIVE FILM TRANSFER APPARATUS AND METHOD FOR CORRECTING STANDARD TRANSFER DISTANCE BASED ON PULSE COUNT BETWEEN SUCCESSIVE INDENTIFICATION DATA

[75] Inventor: Toshiro Akira, Wakayama, Japan

[73] Assignee: Noritsu Koki Co., Ltd., Wakayama-ken, Japan

[21] Appl. No.: 822,459

[22] Filed: Mar. 21, 1997

Related U.S. Application Data

[63] Continuation of Ser. No. 547,542, Oct. 24, 1995, abandoned.

[30] Foreign Application Priority Data

Oct. 27, 1994 [JP] Japan ..... 6-264144

[51] Int. Cl.[6] ..... B65H 23/18; G06F 17/00

[52] U.S. Cl. ..... 226/2; 226/30; 235/375

[58] Field of Search ..... 226/28, 29, 30, 226/31, 2; 353/25, 26 A, 26 R; 235/325, 462, 463

[56] References Cited

U.S. PATENT DOCUMENTS

| | | | |
|---|---|---|---|
| 4,110,020 | 8/1978 | Johnson et al. | 235/463 |
| 4,264,957 | 4/1981 | Pautzke | 226/28 |
| 4,484,522 | 11/1984 | Simeth | 226/28 |
| 4,757,930 | 7/1988 | Ditto | 226/29 |
| 4,781,317 | 11/1988 | Ditto | 226/29 |
| 5,128,519 | 7/1992 | Tokuda | 235/375 |
| 5,272,352 | 12/1993 | Maetani et al. | 353/26 A |

*Primary Examiner*—Charles A. Marmor
*Assistant Examiner*—Matthew A. Kaness
*Attorney, Agent, or Firm*—Wenderoth, Lind & Ponack, L.L.P.

[57] ABSTRACT

A passing movement analyzer is responsive to a pulse signal from a data reader to calculate the time of passing movement of a negative film. The passing of one frame of the negative film is considered detected when two identification codes of the film are read. When the two identification codes are detected by the passing movement analyzer, a drive signal of a driver contains a number of pulses which differs from that of a standard number, and a correction calculator determines that a transfer error exists and adjusts the pulse setting of the drive.

4 Claims, 2 Drawing Sheets

NEGATIVE FILM TRANSFER APPARATUS AND METHOD FOR CORRECTING STANDARD TRANSFER DISTANCE BASED ON PULSE COUNT BETWEEN SUCCESSIVE INDENTIFICATION DATA

This application is a continuation of now abandoned application, Ser. No. 08/547,542, filed Oct. 24, 1995.

BACKGROUND OF THE INVENTION

The present invention relates to a transfer mechanism for conveying lengthwise a negative film having lengthwise extending tracks thereon along which a plurality of identification data are recorded in succession.

In a conventional photographic processing apparatus such as a photographic printing machine, a negative film is transferred through a row of processing stations by the action of a transfer mechanism. It is essential in the printing station to position the negative film at a correct exposure location.

However, the transfer movement will often be disturbed by wear of the rollers in the transfer mechanism.

For compensation, any change in the transfer movement is periodically examined by comparison between actual measurements acquired through conveying of a test negative and theoretical measurements calculated using the mechanical factors of movement including roller diameter and motor specifications. Resultant correction values are then entered manually to correct the change in the transfer movement.

Also, the test negative has scores and marks thereon for ease of measuring the transfer movement.

There are some disadvantages of such a conventional photographic processing apparatus:

(1) The transfer movement of negative films has to be measured frequently thus lowering the efficiency of a correcting operation.

(2) The measurements may include errors attributed to measuring instruments or discrepancies due to a difference between operators' skills, varying the transfer movement and thus the quality of prints.

(3) The comparison between actual measurements and theoretical measurements is needed to obtain correction values, decreasing the efficiency of a correcting operation.

(4) Any miscalculations are possible, impairing the reliability of a correcting operation.

(5) The entry of correction values into the photographic processing apparatus is needed, thus lowering the efficiency of a correcting operation.

(6) A failure is possible in the entry of correction values into the photographic processing apparatus, decreasing the reliability of a correcting operation.

(7) The correction for the transfer movement is carried out with the help of test negatives and measuring instruments, thus being restricted in readiness.

(8) The scores and marks are applied on the test negatives, giving unfavorable effects in reprinting.

(9) The correction is not simple, requiring a considerable level of skill.

(10) The correction is periodically made, reducing the operating time of the apparatus.

It is an object of the present invention, in view of the above predicaments, to provide an improved correcting method and an apparatus for increasing the operating efficiency of a photographic printing machine.

SUMMARY OF THE INVENTION

A method of correcting the transfer movement of a negative film according to the present invention is provided for use in a transfer mechanism which includes a conveying means responsive to a transfer movement control signal for transferring lengthwise the negative film having a lengthwise extending track thereon along which a plurality of identification data records are arranged at intervals of a given distance, a controlling means for producing the transfer movement control signal corresponding to a desired time of transfer movement, and a data detecting means for retrieving identification data from the identification data records on the negative film. In particular, the method comprises the steps of: detecting an actual time of transfer movement of the negative film by examining the identification data records of the negative film which have passed; and correcting the transfer movement control signal in consideration of a difference between the actual time of transfer movement and the desired time of transfer movement.

A negative film transfer movement correcting apparatus according to the present invention is provided in which a negative film having a lengthwise extending track thereon along which a plurality of identification data records are arranged at intervals of a given distance is transferred in its lengthwise direction. More particularly, the apparatus comprises: a controlling means for producing a transfer movement control signal corresponding to a desired time of transfer movement; a conveying means responsive to the transfer movement control signal for transferring the negative film; a passing movement detecting means for detecting an actual time of transfer movement of the negative film by examining the identification data records of the negative film which have passed, and a correcting means for correcting the transfer movement control signal in consideration of a difference between the actual time of transfer movement and the desired time of transfer movement.

In the method of the invention, during conveying of the negative film, having the lengthwise extending track thereon along which the identification data records are arranged at the given intervals, across the transfer mechanism which includes the conveying means responsive to the transfer movement control signal for transferring lengthwise the negative film, the controlling means for producing the transfer movement control signal corresponding to the desired time of transfer movement, and the data detecting means for retrieving the identification data from the identification data records on the negative film, an actual time of transfer movement of the negative film is detected by examining the identification data records of the negative film which have passed, and the transfer movement control signal is corrected in consideration of a difference between the actual time of transfer movement and the desired time of transfer movement. Accordingly, when a change is created in the time of transfer movement determined by the transfer movement control signal caused by wear e.g. of the rollers in the transfer mechanism, it can readily be corrected to give the desired transfer movement.

Also, the apparatus of the invention allows an actual time of transfer movement of the negative film, which has the lengthwise extending track thereon along which the identification data records are arranged at the given intervals and is transferred in its lengthwise direction, to be detected through examining the identification data records of the negative film which have passed. The transfer movement control signal is then corrected by the correcting means operating in consideration of a difference between the actual time of transfer movement and the desired time of transfer movement. As the result, even if a change is created in the transfer movement determined by the transfer movement control signal caused by wear e.g. of the rollers in the transfer mechanism, it can readily be corrected to give the desired transfer movement.

DETAILED DESCRIPTION OF THE PREFERRED EMBODIMENT

Figure 1:
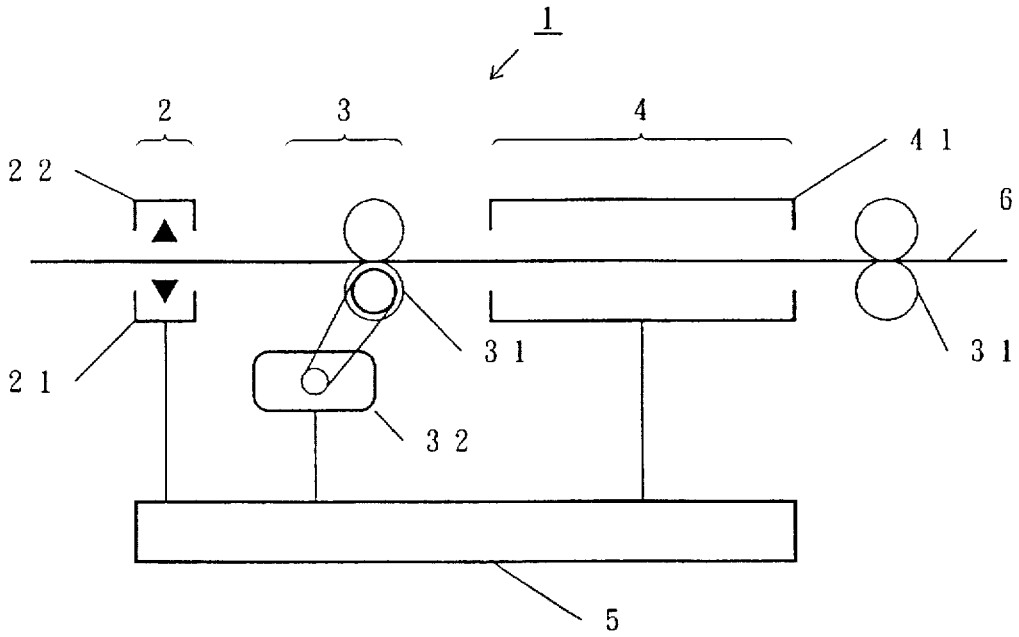
FIG. 1 is a schematic view of a negative transfer movement correcting apparatus in the form of a photographic printing machine showing an embodiment of the present invention.
Figure 2:
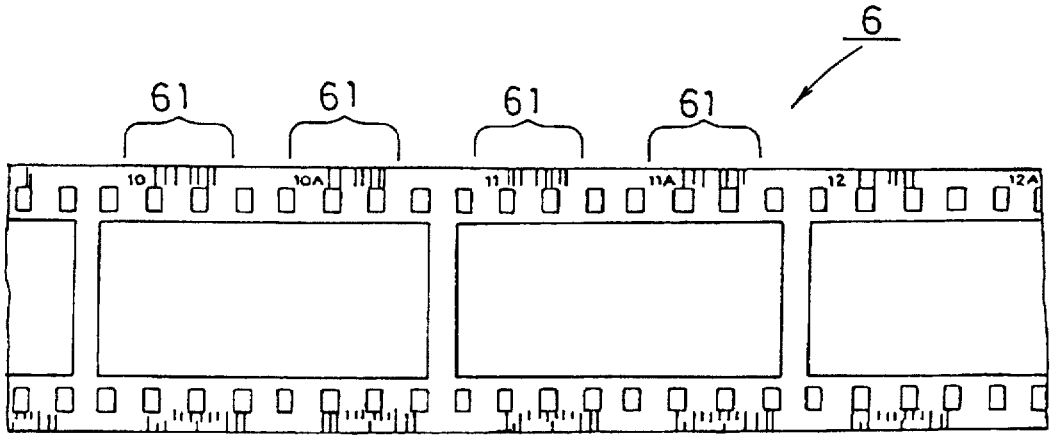
FIG. 2 is a plan view of a negative film processed in the photographic printing machine.

A negative transfer movement correcting apparatus of the present invention will be described in the form of a photographic printing machine referring to the accompanying drawings.

As shown, the photographic printing machine 1 for printing a negative film 6 comprises a data reader 2, a transfer mechanism 31 an exposure station 4, and a controller 5.

The negative film 6 carries a plurality of identification codes 61, e.g. DX codes, arranged on one edge thereof in the form of latent images, two codes being assigned to one frame.

The data reader 2 includes a sensor light source 22 and a photo sensor 21. The photo sensor 21 receives a ray of light emitted from the sensor light source 22 and passed through the identification code 61 of the negative film 6 and produces a pulse signal corresponding to information of the identification code 61.

The transfer mechanism 3 comprises pairs of rollers 31 and a drive motor 32 for driving the rollers 31. The exposure station 4 contains an exposure masking 41.

Figure 3:
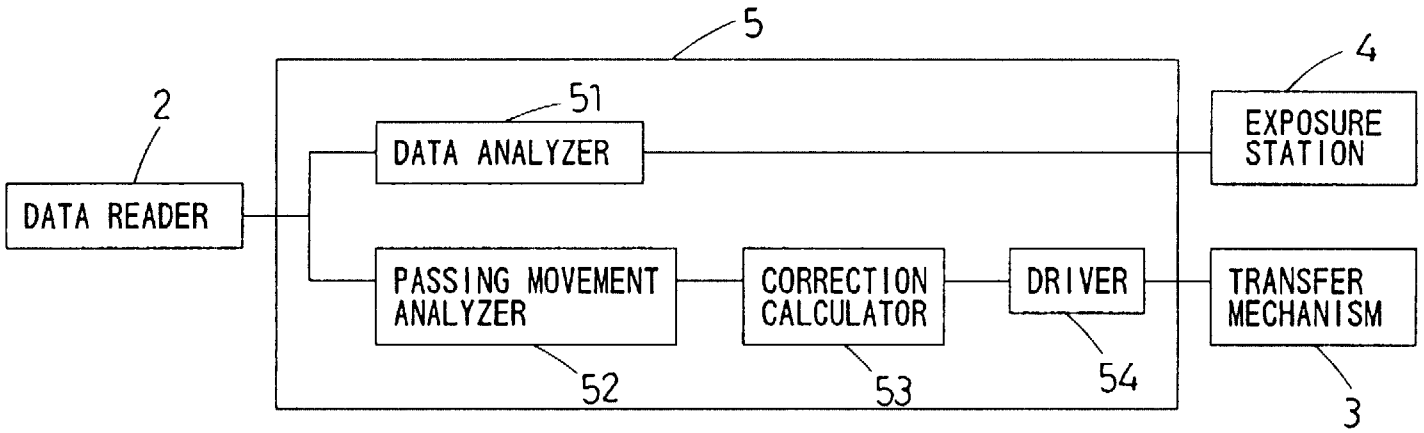
FIG. 3 is a block diagram showing a circuitry arrangement of the photographic printing machine.

The controller 5 comprises a data analyzer 51, a passing movement analyzer 52, a correction calculator 53, and a driver 54, as shown in FIG. 3. The data analyzer 51 is responsive to the pulse signal from the data reader 2 for identifying the sensitivity and the name of a film manufacturer recorded on the negative film 6 and determining the exposure settings for printing the negative film 6. The driver 54 is initialized to deliver a first number (A) of pulses of a drive signal necessary for advancing the negative film 6 by one frame of the standard size.

The passing movement analyzer 52 is also responsive to the pulse signal from the data reader 2 for calculating the passing movement of the negative film 6. It detects the time required of passing of one frame of the negative film 6 when reading two of the identification codes 61.

When two of the identification codes 61 are detected by the passing movement analyzer 52 and the drive signal of the driver 54 carries a second number (B) of pulses, the correction calculator 53 determines a transfer error ((A)–(B)) and shifts the pulse setting to the second number (B) of pulses in the driver 54.

Accordingly, the driver 54 releases B pulses of the drive signal so that one frame of the transfer movement is correctly performed.

It is unnecessary to perform the correction for transfer movement for every frame. It may be predetermined to carry out the correction once in one negative film 6.

For example, some of the front frames of a newly loaded negative film are subjected to the correction while the remaining frames remain intact.

As set forth above, if the time of transfer movement defined by the number of pulses of the drive signal is varied due to wear of the rollers in the transfer mechanism 3, the pulse number of the drive signal is corrected by reviewing the pulse signal from the data reader 2, thus giving a desired distance of the transfer movement.

The correction process according to the present invention requires no manual and is highly accurate, effective, and reliable.

Although the drive motor 32 of the transfer mechanism in the illustrated embodiment is a stepping motor, it may be a servo motor accompanied by a rotary encoder.

The present invention is not limited to the photographic printing apparatus but may be applied to a development apparatus, a scanner, or any other device where accurate intermittent transfer movements are required.

It would also be understood that the functions of the data analyzer 51, passing movement analyzer 52, and correction calculator 53 in the controller 5 are implemented by a combination of a microcomputer and its software programs.

I claim:

1. A method of transferring a negative film to a processing station, wherein said negative film has a lengthwise track along which are recorded at intervals of a given length identification data containing negative film processing information indicative of processing conditions to be conducted at said processing station, said method comprising:

conveying said negative film by a transfer mechanism in response to a transfer control signal;

establishing a value of said transfer control signal representative of a standard time necessary to convey said negative film a transfer distance between first and second said identification data;

detecting said identification data and producing a pulse signal corresponding to said negative film processing information of said identification data;

determining an actual time taken to convey said negative film said transfer distance between said first and second identification data in response to said pulse signal;

comparing said actual time with said standard time to determine a transfer time error therebetween; and correcting the value of said transfer control signal to compensate for said transfer time error, such that said transfer mechanism conveys said negative film by said transfer distance.

2. A method as claimed in claim 1, wherein said transfer control signal is a pulse signal, said standard time is defined by a standard number of pulses of said transfer control signal to obtain conveyance of said negative film by said transfer distance, said determining said actual time comprises determining a number of pulses of said transfer control signal during conveyance of said negative film by said transfer distance, and said comparing comprises comparing the thus determined number of pulses with said standard number of pulses.

3. An apparatus for use in transferring to a processing station a negative film having a lengthwise track along which are recorded at intervals of a given length identification data containing negative film processing information indicative of processing conditions to be conducted at the processing station, said apparatus comprising:

a transfer mechanism for conveying the negative film in response to a transfer control signal;

means for establishing a value of said transfer control signal representative of a standard time necessary to convey the negative film a transfer distance between first and second of the identification data;

detector means for detecting the identification data and for producing a pulse signal corresponding to the negative film processing information of the identification data;

determining means for determining an actual time taken to convey the negative film the transfer distance between the first and second identification data in response to the pulse signal;

means for comparing said actual time with said standard time to determine a transfer time error therebetween; and means for correcting the value of said transfer control signal to compensate for said transfer time error, such that said transfer mechanism conveys the negative film by said transfer distance.

4. An apparatus as claimed in claim 3, wherein said transfer movement control signal is a pulse signal, said standard time is defined by a standard number of pulses of said transfer movement control signal to obtain conveyance of the negative film by said transfer distance, said determining means is operable to determine a number of pulses of said transfer movement control signal during conveyance of the negative film by said transfer distance, and said means for comparing is operable to compare the thus determined number of pulses with said standard number of pulses.

* * * * *